US007288735B2

(12) United States Patent
Naijo

(10) Patent No.: US 7,288,735 B2
(45) Date of Patent: Oct. 30, 2007

(54) SWITCHING DEVICE

(75) Inventor: Toshihiro Naijo, Brussels (BE)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 11/380,745

(22) Filed: Apr. 28, 2006

(65) Prior Publication Data

US 2006/0254900 A1 Nov. 16, 2006

(30) Foreign Application Priority Data

May 10, 2005 (JP) ..... P2005-137305

(51) Int. Cl.
*H01H 1/10* (2006.01)

(52) U.S. Cl. ..... 200/512; 200/406; 200/341

(58) Field of Classification Search ..... 200/520, 200/402, 406, 341, 510–516
See application file for complete search history.

(56) References Cited

U.S. PATENT DOCUMENTS 4,927,787 A * 5/1990 Patel ..... 439/189
5,667,062 A * 9/1997 Yasufuku et al. ..... 200/536
6,271,491 B1 * 8/2001 Ono et al. ..... 200/520
6,384,357 B1 * 5/2002 Morrison ..... 200/520
6,465,752 B2 * 10/2002 Meagher et al. ..... 200/61.73
6,483,055 B1 * 11/2002 Tanabe et al. ..... 200/85 A
6,563,068 B2 * 5/2003 Yamagata et al. ..... 200/406
6,639,161 B2 * 10/2003 Meagher et al. ..... 200/61.73
6,683,265 B2 * 1/2004 Masuda ..... 200/406
6,756,555 B2 * 6/2004 Lin ..... 200/512
6,967,300 B1 * 11/2005 Mizuno et al. ..... 200/512

* cited by examiner

*Primary Examiner*—K. Richard Lee
(74) *Attorney, Agent, or Firm*—Morgan, Lewis & Bockius LLP

(57) ABSTRACT

The conductors are shaped into a flat shape and a part of the conductors is exposed from the recess portion formed in a part of the insulator respectively to constitute fixed contacts. Therefore, there is no necessity to bend the conductors and thus a bending error is not caused. As a result, no level difference can be generated between the fixed contacts and the problem of defective contact due to such level difference can be never caused.

5 Claims, 3 Drawing Sheets

PRIOR ART

PRIOR ART

SWITCHING DEVICE

BACKGROUND OF THE INVENTION

The present invention relates to a switching device in which a structure constituting fixed contacts is improved.

Generally, the switching device in which the fixed contact is formed by the wiring pattern on the wiring board is offered. However, the wiring board is high cost, and thus the switching devices shown in FIG. 4 to FIG. 6 are offered in place of the above switching device.

In the switching devices shown in FIG. 4 to FIG. 6, a conductor 2 is buried in an insulator 1 and a part of this conductor is exposed This exposed portion is used as a fixed contact 4 corresponding to a movable contact 3, and thus remaining portions of the conductor 2 are buried in the insulator 1 for the purpose of insulation. Therefore, bent portions M where the exposed portion is raised one step higher than other portions are formed on the conductor 2 on opposite sides (right and left sides in FIG. 4) of the exposed portion.

In the case of the illustrated example, the movable contact 3 is fixed to a bottom surface of a protruded portion 5*a* of a sheet 5 made of elastic member such as rubber, or the like (so-called rubber contact). The movable contact 3 when pushed by a push button 6 via a pusher 7 is brought into contact with two fixed contacts 4 (see FIG. 5) such that the contact 3 bridges over the two fixed contacts 4.

In the case of the above structure, a cost can be suppressed lower than the structure in which the fixed contact is constructed by the wiring pattern on the wiring board. However, due to a bending error of the bend portion M, a level difference S shown in FIG. 6 tends to occur between two fixed contacts 4. Therefore, there is a possibility that a contacting condition of the movable contact 3 to two fixed contacts 4 becomes uncertain since the movable contact 3 contacts one contact but may not contact the other due to this level difference S, i.e., so-called defective contact is caused.

SUMMARY OF THE INVENTION

The present invention has been made in view of the above circumstances, and it is an object of the present invention to provide a switching device which generates no level difference between fixed contacts and never causes the problem of defective contact due to such level difference, in such a switch structure that a conductor is buried in an insulator to expose partially and this exposed portion is used as the fixed contact.

In order to solve the above problem, the present invention provides the following arrangement.

(1) A switching device comprising:

an insulator including a recess portion; and a pair of conductors including flat fixed contacts connectable with a movable contact, respectively, wherein the flat fixed contacts are buried in the insulator and the fixed contacts are exposed partially from the recess portion.

(2) The switching device according to (1), wherein the pair of conductors extend parallel to each other.

(3) The switching device according to (1), wherein the movable contact is adapted to bridge the fixed contacts.

(4) The switching device according to (3) further comprising a sheet including a protruded portion which is movable relative to the fixed contacts and to which the movable contact is fixed.

(5) The switching device according to (1), wherein the conductors include terminals projected from the insulator to be connected to a mate connector, respectively.

According to the above arrangement, the conductor is shaped into a flat shape and a part of the conductors is exposed from the recess portion formed in a part of an insulator respectively to constitute the fixed contacts. Therefore, there is no need to bend the conductor and thus a bending error is not caused. As a result, no level difference can be generated between fixed contacts and the problem of defective contact due to such level difference can never be caused.

DETAILED DESCRIPTION OF PREFERRED EMBODIMENTS

An embodiment of the present invention will be explained with reference to FIG. 1 to FIG. 3 hereinafter.

Figure 1:
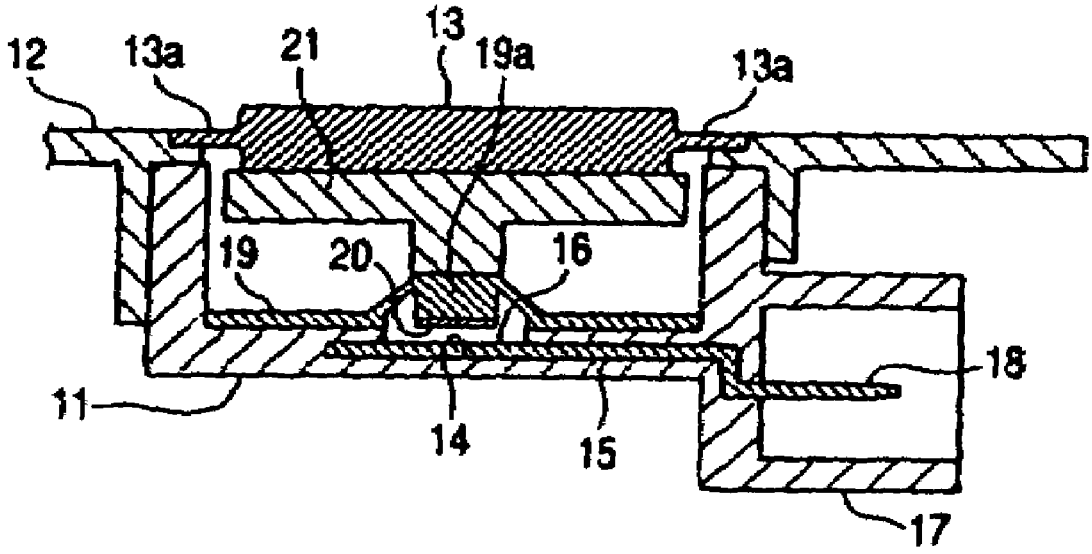
FIG. 1 is an overall longitudinal side view showing an embodiment of the present invention.
Figure 2:
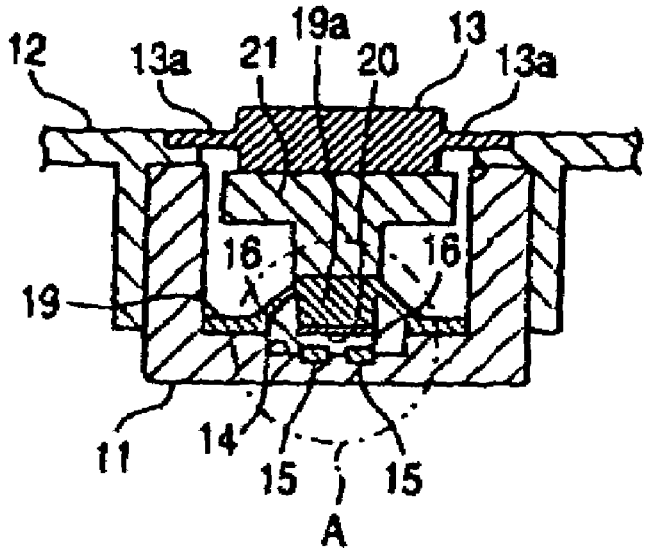
FIG. 2 is an overall longitudinal front view.
Figure 3:
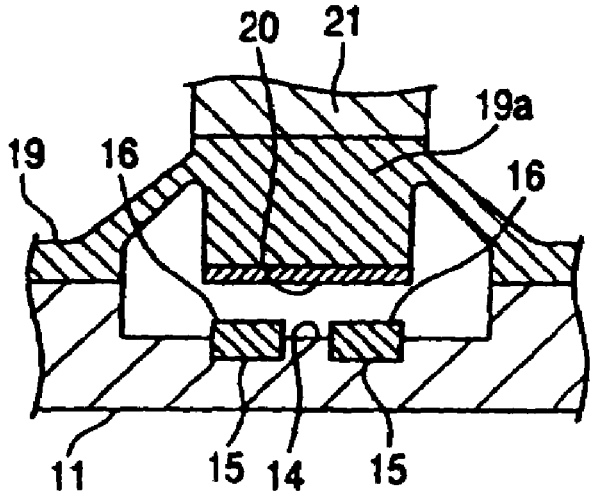
FIG. 3 is an enlarged view of an A portion in FIG. 2.
Figure 4:
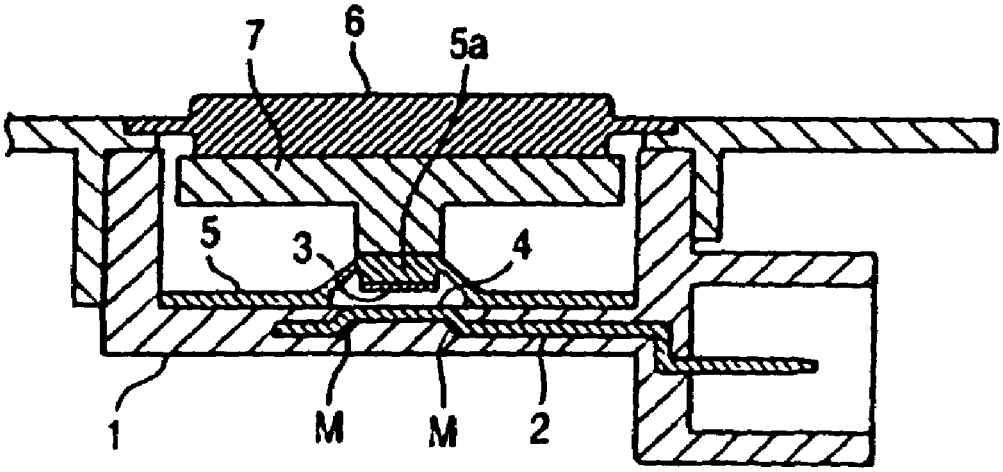
FIG. 4 is a view corresponding to FIG. 1 in the prior art.
Figure 5:
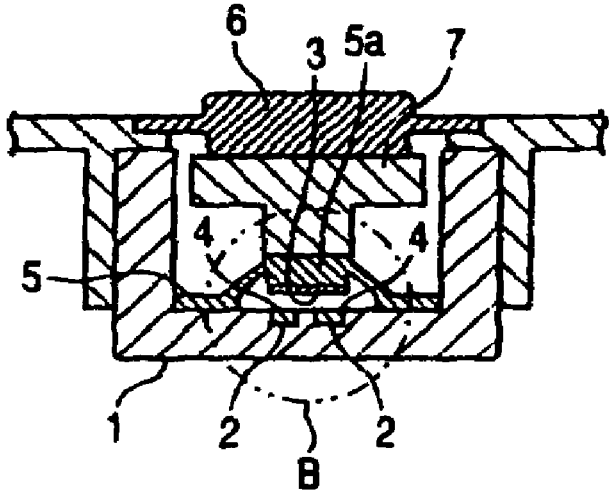
FIG. 5 is a view corresponding to FIG. 2 in the prior art.
Figure 6:
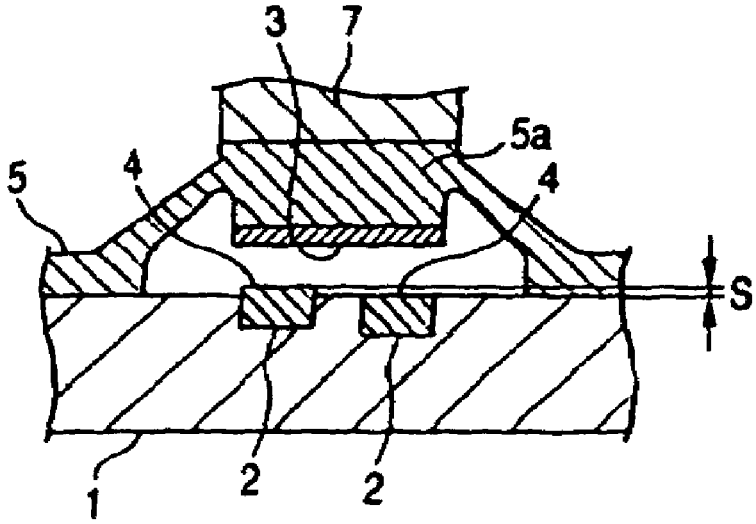
PRIOR ART FIG. 6
FIG. 6 is an enlarged view of a B portion in FIG. 5 (a view corresponding to FIG. 3).

First, FIG. 1 and FIG. 2 show an overall structure of a switching device. A whole outer shell is formed by an insulator 11, a body 12 put on the insulator 11, and a push button 13 fitted to the body 12.

In detail, the insulator 11 forms a box shape a top surface of which is opened, and a recess portion 14 is formed in an almost center area of a bottom portion of the insulator 11. Two conductors 15 which extend parallel to each other are buried in the insulator and a part of each of two conductors 15 (see FIG. 2) is exposed from the recess portion 14, particularly its bottom surface, respectively. This exposed portion constitutes a fixed contact 16. A portion of each conductor 15 extending from one side of the insulator through the recess portion to the other side of the insulator, i.e., the fixed contact 16, are shaped into a flat shape, and remaining portions except the exposed portions (the fixed contact 16 portions) are buried in the insulator 11 for the purpose of insulation (see FIG. 1).

In this embodiment, the insulator 11 is formed by molding a synthetic resin. The two conductors 15 are inserted into the synthetic resin during the molding, and then the insulator 11 including the recess portion 14 is molded in that state to expose the part of two conductors 15 from the bottom surface of the recess portion 14 respectively.

The conductors 15 are projected into an inside of a connector housing portion 17 (see FIG. 1) formed at a rear surface portion of the insulator 11, and a projected portion constitutes a terminal 18. That is, the conductor 15 is used as both the fixed contact 16 and the terminal 18. Then, a mate connector (not shown) is connected to the terminal 18.

Then, a sheet 19 made of an elastic member such as rubber, or the like is deposited onto the bottom surface of the insulator 11. A protruded portion 19*a* is formed previously in a center portion of this sheet 19. A movable contact 20 (so-called a rubber contact) fixed to a bottom surface of the protruded portion 19*a* is caused to be opposed to the fixed contacts 16, particularly oppose to the fixed contacts 16 at a predetermined distance.

In contrast, a pusher 21 is put on an upper surface of the protruded portion 19*a*, and a lower surface of the push button 13 is brought into contact with this upper surface. Here, the push button 13 has a thin elastic portion 13*a* around its peripheral portion. When the push button 13 is pushed downward, the thin elastic portion 13*a* is bent to push the pusher 21 and then the pusher 21 pushes the protruded portion 19*a* of the sheet 19 to cause the movable contact 20 to contact to the fixed contacts 16, so that these two fixed contacts 16 are bridged.

In this manner, according to this configuration, the conductor 15 is shaped into a flat shape, and a part of the conductors 15 is exposed from the recess portion 14 formed in a part of the recess portion 14 respectively to constitute the fixed contacts 16. Therefore, there is no need to bend the conductor 15 unlike the related art and thus a bending error does not occur. As a result, no level difference is generated between the fixed contacts 16 and the problem of defective contact of the movable contact 20 due to such level difference is never caused.

Here, the switching device is not limited to the above opposing type in which the movable contact 20 is opposed to the fixed contacts 16 and is connected to or disconnected from the fixed contacts 16. The slide type switching device in which the movable contact is connected to or disconnected from the fixed contact by sliding the movable contact 20 may be employed.

Moreover, the present invention is not limited merely to the embodiment explained above and illustrated in the figures. The present invention can be applied while changing appropriately within a range that does not depart from the concept of the invention.

What is claimed is:

1. A switching device having an on position and an off position comprising:

an insulator including a recess portion; and a pair of conductors including flat fixed contacts connectable with a movable contact, respectively, wherein the flat fixed contacts are buried in the insulator and the fixed contacts are exposed partially from the recess portion, wherein top surfaces of portions of the pair of conductors which are buried in the insulator and top surfaces of portions of the pair of conductors which are exposed from the recess are on the same plane, and the movable contact is not in contact with either of the fixed contacts when the switching device is in the off position.

2. The switching device according to claim 1, wherein the pair of conductors extend parallel to each other.

3. The switching device according to claim 1, wherein the movable contact is adapted to bridge the fixed contacts.

4. The switching device according to claim 3 further comprising a sheet including a protruded portion which is movable relative to the fixed contacts and to which the movable contact is fixed.

5. The switching device according to claim 1, wherein the conductors include terminals projected from the insulator to be connected to a mate connector, respectively.

* * * * *